US008005409B2

(12) United States Patent
Ishii et al.

(10) Patent No.: US 8,005,409 B2
(45) Date of Patent: Aug. 23, 2011

(54) DEVELOPMENT DEVICE

(75) Inventors: Yasuyuki Ishii, Machida (JP); Hideki Kosugi, Yokohama (JP); Tomoko Takahashi, Yokohama (JP); Yoshinori Nakagawa, Yokohama (JP); Masaaki Yamada, Tokyo (JP); Ichiro Kadota, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 225 days.

(21) Appl. No.: 12/468,955

(22) Filed: May 20, 2009

(65) Prior Publication Data

US 2009/0290901 A1 Nov. 26, 2009

(30) Foreign Application Priority Data

May 21, 2008 (JP) ..... 2008-133426

(51) Int. Cl.
*G03G 15/08* (2006.01)
*G03G 15/06* (2006.01)

(52) U.S. Cl. ..... 399/289; 399/55; 399/103

(58) Field of Classification Search ..... 399/241, 399/242, 103, 265, 289, 291, 55
See application file for complete search history.

(56) References Cited

U.S. PATENT DOCUMENTS 5,311,258 A * 5/1994 Brewington et al. ..... 399/291
5,416,568 A * 5/1995 Yoshiki et al.
5,592,265 A 1/1997 Sakuraba et al.
6,546,383 B1 4/2003 Ogawa
6,721,534 B2 4/2004 Takahashi
6,856,780 B2 2/2005 Kadota et al.
6,947,682 B2 9/2005 Kosugi et al.
7,212,753 B2 5/2007 Suzuki et al.
7,308,222 B2 12/2007 Nakagawa et al.
7,313,336 B2 12/2007 Kadota et al.
7,340,204 B2 3/2008 Nakazato et al.
7,359,660 B2 4/2008 Nakazato et al.
7,412,190 B2 8/2008 Kadota et al.
7,526,238 B2 4/2009 Yamada et al.
(Continued)

FOREIGN PATENT DOCUMENTS

CN 1955858 A 5/2007
(Continued)

OTHER PUBLICATIONS

Office Action issued Nov. 12, 2010 in China Application No. 200910203845.X.

*Primary Examiner* — Susan S Lee
(74) *Attorney, Agent, or Firm* — Oblon, Spivak, McClelland, Maier & Neustadt, L.L.P.

(57) ABSTRACT

A development device includes an open-ended housing, a rotatable roller, an array of multiple primary electrodes, a voltage source, a sealing member, and a secondary electrode. The housing accommodates toner for application to the photoconductive surface through an end opening thereof. The roller has an outer circumferential surface to deliver the toner from within the housing to a development zone. The array of multiple primary electrodes are aligned with each other on the roller surface. The voltage source applies a periodic pulse voltage to at least a subset of the primary electrodes to generate an oscillating primary electric field. The sealing member seals clearance between the roller surface and an edge of the end opening downstream from the development zone. The secondary electrode generates a secondary electric field to force the toner from the sealing member toward the roller surface to prevent premature removal of the toner.

6 Claims, 10 Drawing Sheets

U.S. PATENT DOCUMENTS

| | | | | |
|---|---|---|---|---|
| 7,647,013 | B2 * | 1/2010 | Hazeyama | 399/265 |
| 7,672,625 | B2 * | 3/2010 | Takahashi et al. | 399/265 |
| 2006/0251449 | A1 * | 11/2006 | Takahashi et al. | 399/265 |
| 2007/0013924 | A1 | 1/2007 | Sakai et al. | |
| 2007/0015071 | A1 | 1/2007 | Tsukamoto et al. | |
| 2007/0086811 | A1 | 4/2007 | Tsukamoto et al. | |
| 2007/0160395 | A1 | 7/2007 | Kosugi et al. | |
| 2007/0212121 | A1 * | 9/2007 | Takahashi et al. | 399/265 |
| 2007/0242985 | A1 | 10/2007 | Aoki et al. | |
| 2008/0089720 | A1 | 4/2008 | Tsukamoto et al. | |
| 2008/0089723 | A1 | 4/2008 | Tsukamoto et al. | |
| 2008/0124138 | A1 | 5/2008 | Kosugi et al. | |
| 2008/0286015 | A1 | 11/2008 | Kadota et al. | |
| 2009/0016781 | A1 | 1/2009 | Takahashi et al. | |
| 2009/0022523 | A1 | 1/2009 | Kadota et al. | |
| 2009/0035025 | A1 | 2/2009 | Ishii et al. | |
| 2009/0067889 | A1 | 3/2009 | Nakagawa et al. | |
| 2009/0074431 | A1 | 3/2009 | Aoki et al. | |

FOREIGN PATENT DOCUMENTS

| | | |
|---|---|---|
| JP | 2007-133376 | 5/2007 |
| JP | 2007-133387 | 5/2007 |
| JP | 2007-133388 | 5/2007 |
| JP | 2007-133389 | 5/2007 |
| JP | 2007-133390 | 5/2007 |

* cited by examiner

DEVELOPMENT DEVICE

CROSS-REFERENCE TO RELATED APPLICATIONS

The present patent application claims priority pursuant to 35 U.S.C. §119 from Japanese Patent Application No. 2008-133426 filed on May 21, 2008, the contents of which are hereby incorporated by reference herein in their entirety.

BACKGROUND OF THE INVENTION

1. Field of the Invention

The present invention relates to a development device, and more particularly, to a development device including a developer roller that generates an oscillating electric field under which charged toner particles jump across a development gap to develop an electrostatic latent image recorded on a photoconductive surface.

2. Discussion of the Background

In electrophotographic image formation, development devices are used to develop an electrostatic latent image recorded on a photoconductive surface with charged toner particles. Generally, an electrophotographic development device includes an open-ended developer housing defining a developer chamber that accommodates developer and/or toner particles, and a developer roller rotatably mounted in the developer housing. The developer roller has its outer circumferential surface partially accommodated within the developer chamber and partially facing a photoconductive surface through an end opening in the developer housing. The developer roller rotates so as to advance toner loaded on the circumferential surface from inside the developer chamber to a development gap or zone defined between opposed surfaces of the developer roller and the photoconductive surface having an electrostatic latent image recorded thereon. Charged toner particles are transferred from the developer roller to the photoconductive surface across the development gap, and adhere to the electrostatic latent image to develop it into a visible image.

A particular type of such electrophotographic development is so-called hopping development, which generates a flare or aerosol cloud of charged toner particles with an oscillating electric field so as to transfer toner to an electrostatic latent image across a development gap. In a typical configuration, the hopping development device employs a tubular developer roller with multiple thin electrodes extending longitudinally along the roller at regular intervals all around a circumference of the developer roller. When energized, these electrodes generate an oscillating electric field therebetween, under which charged toner particles hop or move repeatedly to and fro between adjacent electrodes. In the development gap, hopping particles jump close to the photoconductive surface, and eventually adhere to an electrostatic latent image due to an electrostatic attractive force emanating therefrom.

Owing to the reciprocating hopping motion liberating toner from the developer roller, hopping development can selectively transfer toner to an electrostatic latent image with an extremely low voltage (e.g., on the order of several tens of volts) between charged image areas and adjacent non-image areas. The result is a low-power development process design that compares favorably, at least in terms of power consumption, to a configuration that transfers toner across a development gap primarily based on a development bias or voltage applied between a developer roller and an electrostatic latent image.

One common problem with a development device in which the developer roller is accommodated in an open-ended housing is leakage of toner from the housing opening. That is, toner particles, stirred up within the developer chamber, leak through any clearance between the surface of the developer roller and edges of the housing opening. Such leaking toner results in contamination of areas adjacent to the development device as well as smudges on recording media (e.g., sheets of paper, etc.) passing through the contaminated surfaces during image formation.

To prevent toner leakage from an end opening in a developer housing, conventional development devices employ a cantilevered flexible film member or blade to seal the opening. Typically, the sealing blade has one edge supported on the edge of the housing opening and another edge contacting the circumferential surface of a developer roller. The contacting edge of the flexible blade prevents airborne toner from escaping from the developer chamber while allowing toner resting on the roller surface to pass therethrough to or from the developer chamber. Such weak sealing by a cantilevered flexible member effectively prevents toner leakage in a conventional development device that transfers toner across a development gap with an electrically biased developer roller.

Unfortunately, the conventional sealing technique is not compatible with a hopping development device described above. This is because hopping toner, which has little adhesion to the surface of a developer roller, readily migrates from the roller surface when brought into direct contact with a sealing member. Naturally, such migration of toner results in reduced efficiency of toner delivery to or from the development zone, causing various adverse effects on the performance of the image forming apparatus employing the hopping development device.

For example, a sealing blade provided to an upstream edge of the housing opening can remove substantial amounts of toner particles loaded for delivery to the development zone. This results in development deficiencies due to insufficient supply of toner in the development zone, even when the developer roller is loaded with proper amounts of toner inside the developer chamber. On the other hand, a sealing blade provided to a downstream edge of the housing opening can remove residual toner from the developer roller before the toner can return to the developer chamber. This results in toner particles accumulating on the sealing blade and eventually spreading out to contaminate areas adjacent to the development device.

These detrimental effects of a cantilevered blade sealing the clearance between the opening edges and the hopping developer roller could be alleviated by providing a narrower gap between the free edge of the sealing blade and the roller surface roller instead of directly contacting the blade edge and the roller surface. However, such a configuration is impractical because the alleviation is ineffective when the edge-to-surface gap is greater than the height to which toner particles jump from the roller surface.

SUMMARY OF THE INVENTION

Exemplary aspects of the present invention are put forward in view of the above-described circumstances, and provide a novel development device that develops an electrostatic latent image recorded on a photoconductive surface.

In one exemplary embodiment, the novel development device includes an open-ended housing, a rotatable roller, an array of multiple primary electrodes, a voltage source, a sealing member, and a secondary electrode. The open-ended housing accommodates toner for application to the photoconductive surface through an end opening thereof. The rotatable roller has an outer circumferential surface thereof partially accommodated within the housing and partially facing the photoconductive surface through the end opening to deliver the toner from within the housing to a development zone defined between the roller surface and the photoconductive surface. The array of multiple primary electrodes are aligned parallel with each other on and extending longitudinally along the roller surface. The voltage source applies a periodic pulse voltage to at least a subset of the primary electrodes to generate an oscillating primary electric field under which the toner moves back and forth between neighboring primary electrodes and consequently jumps across the development zone to adhere to the electrostatic latent image. The sealing member seals clearance between the roller surface and an edge of the end opening. The secondary electrode faces at least a portion of the roller surface closest to the sealing member and generates, when energized, a secondary electric field to force the toner toward the roller surface to counteract an electrostatic force of the primary electric field repelling the toner from the roller surface.

In one exemplary embodiment, the novel development device includes an open-ended housing, a rotatable roller, an array of multiple primary electrodes, a voltage source, a sealing member, and a secondary electrode. The open-ended housing accommodates toner for application to the photoconductive surface through an end opening thereof. The rotatable roller has an outer circumferential surface thereof partially accommodated within the housing and partially facing the photoconductive surface through the end opening to deliver the toner from within the housing to a development zone defined between the roller surface and the photoconductive surface. The array of multiple primary electrodes are aligned parallel with each other on and extending longitudinally along the roller surface. The voltage source applies a periodic pulse voltage to at least a subset of the primary electrodes to generate an oscillating primary electric field under which the toner moves back and forth between neighboring primary electrodes and consequently jumps across the development zone to adhere to the electrostatic latent image. The sealing member seals clearance between the roller surface and an edge of the end opening downstream from the development zone. The secondary electrode faces the roller surface upstream from a contact area between the sealing member and the roller surface, and generates, when energized, a secondary electric field to force the toner from the sealing member toward the roller surface to counteract the sealing member interfering with the toner passing therethrough as well as an electrostatic force of the primary electric field repelling the toner from the roller surface.

In one exemplary embodiment, the novel development device includes an open-ended housing, a rotatable roller, an array of multiple electrodes, a voltage source, a sealing member, and a secondary electrode. The open-ended housing accommodates toner for application to the photoconductive surface through an end opening thereof. The rotatable roller has an outer circumferential surface thereof partially accommodated within the housing and partially facing the photoconductive surface through the end opening to deliver the toner from within the housing to a development zone defined between the roller surface and the photoconductive surface. The array of multiple electrodes are aligned parallel with each other on and extending longitudinally along the roller surface. The voltage source applies a periodic pulse voltage to at least a subset of the electrodes to generate an oscillating primary electric field under which the toner moves back and forth between neighboring primary electrodes and consequently jumps across the development zone to adhere to the electrostatic latent image. The sealing member seals clearance between the roller surface and an edge of the end opening. The voltage source energizes at least one of the electrodes closest to the sealing member with a direct current voltage of a polarity opposite to that of the toner to counteract an electrostatic force of the electric field repelling the toner from the roller surface.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
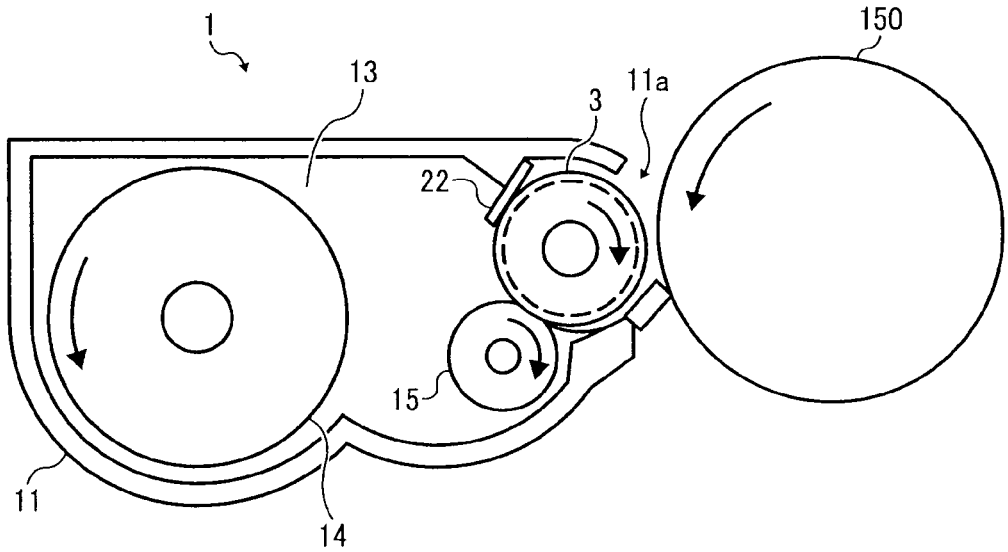
FIG. 1 schematically illustrates a general configuration of a development device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, exemplary embodiments of the present patent application are described.

FIG. 1 schematically illustrates a general configuration of a development device 1 according to this patent specification.

As shown in FIG. 1, the development device 1 includes an open-ended housing 11 defining a developer chamber 13 that accommodates developer and/or toner particles for application to a photoconductive drum 150 through an end opening 11*a*. The development device 1 has a developer roller 3 with an outer circumferential surface thereof partially accommodated in the developer chamber 13 and partially facing the photoconductive drum 150 through the end opening 11*a*. The developer chamber 13 also accommodates a paddle 14 on a side away from the end opening 11*a*, as well as a loading roller 15 and a metering blade 22 adjacent to the developer roller 3.

The photoconductor drum 150 is a motor-driven rotatable cylinder with an outer photoconductive surface formed of organic photoconductive material approximately 13 micrometers (μm) in thickness. When driven by a motor, not shown, the photoconductor drum 150 rotates at a given linear speed counterclockwise in the drawing to pass the photoconductive surface through charging and exposure devices, not shown, to form an electrostatic latent image with a given potential and resolution upstream from the development device 1. For example, the charging process may uniformly charge the photoconductive surface to a potential ranging from −500 to −300 volts (V), followed by the exposure process selectively discharging the photoconductive surface to form an electrostatic latent image with a resolution of 1200 dots per inch (dpi) and a resulting potential on the order of −50 to 0 V.

In the development device 1, the paddle 14 rotates counterclockwise in the drawing to agitate and direct toner toward the loading roller 15. The loading roller 15 has a cylindrical body formed of elastic material, such as sponge or expanded cellular foam, surrounding a metal shaft supported by bearings, not shown. When driven by a motor, not shown, the loading roller 15 rotates clockwise in the drawing to collect toner on its elastic surface for delivery to a loading zone defined between the loading roller 15 and the developer roller 3.

The developer roller 3 rotates in the same direction as the loading roller 15, so as to establish frictional contact therebetween. In the loading zone, a supply of toner is transferred from the loading roller 15 to the developer roller 3 while triboelectrically charged to a negative potential by friction against the roller surfaces. Such transfer of toner may be enhanced by applying an electrical bias or voltage between the loading roller 15 and the developer roller 3.

Subsequently, toner loaded on the developer roller 3 advances to a metering zone defined between the metering blade 22 and the developer roller 3, exits the developer chamber 13, and then reaches a development zone or gap defined between the developer roller 3 and the photoconductor drum 150. Charged toner particles are transferred across the development zone to adhere to an electrostatic latent image recorded on the photoconductor drum 150, thereby developing it into a visible toner image.

After development, the toner image formed on the rotating photoconductor drum 150 leaves the development zone for subsequent transfer and fixing onto a recoding sheet. On the other hand, toner particles that have not been used and which remain on the roller surface return to the developer housing 11 to reenter the loading zone.

Again in the loading zone, the loading roller 15 unloads a certain amount of residual toner and reloads new toner on the developer roller 3, thereby maintaining a constant amount of toner for supply to a subsequent development cycle. Alternatively, instead of the loading roller 15 rotating against the developer roller 3 to simultaneously unload and reload the developer roller 3, it is also possible to provide separate members to independently perform removal and supply of toner on the roller surface.

According to this patent specification, the development device 1 features a "hopping" development mechanism, in which charged toner particles hop on the outer surface of the developer roller 3 under an oscillating electric field. The following describes configuration of the hopping development mechanism with particular reference to FIGS. 2 through 5.

Figure 2:
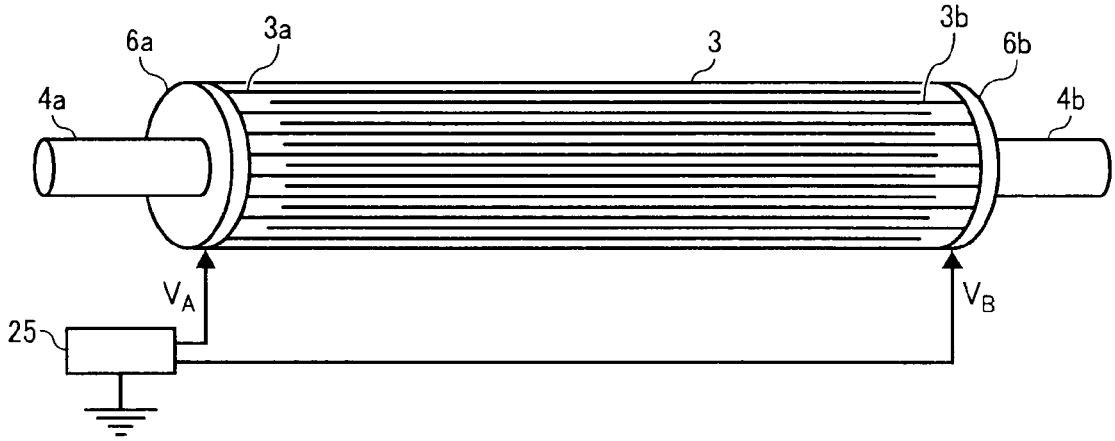
FIG. 2 is a perspective view schematically illustrating a developer roller used in the development device according to one embodiment of this patent specification.

FIG. 2 is a perspective view schematically illustrating the developer roller 3 used in the development device 1 according to one embodiment of this patent specification.

As shown in FIG. 2, the developer roller 3 has first and second sets of multiple primary electrodes 3*a* and 3*b* arranged around an outer circumferential surface thereof, first and second axles 4*a* and 4*b* rotatably supported on bearings, not shown, as well as a first metal flange 6*a* from the center of which extends the axle 4*a* at a first end of the roller 3, and a second metal flange 6*b* from the center of which extends the axle 4*b* at a second end of the roller 3. All the first set of electrodes 3*a* are electrically connected together through the flange 6*a* at the first end, while all the second set of electrodes 3*b* are electrically connected together through the flange 6*b* at the second end. In addition, the developer roller 3 has a voltage source 25 with a pair of stationary electrodes, not shown, held in sliding contact with the end flanges 6*a* and 6*b* to form a mechanism to generate an oscillating electric field as will be described later in more detail.

Figure 3A:
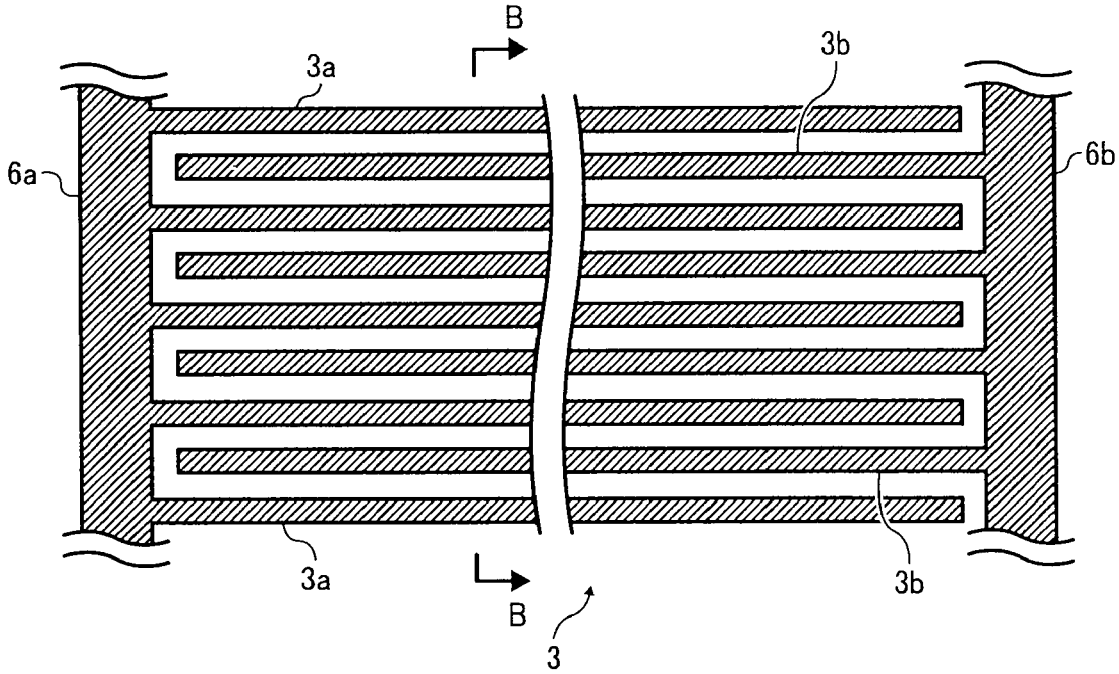
FIGS. 3A and 3B are enlarged top and cross-sectional views, respectively, of a circumferential surface of the developer roller of FIG. 2.
Figure 3B:
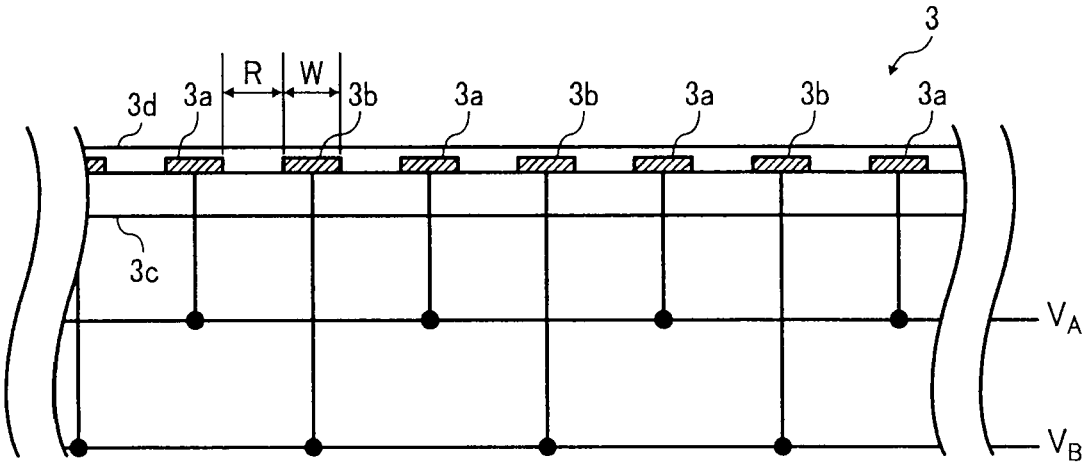

FIGS. 3A and 3B are enlarged top and cross-sectional views, respectively, of the circumferential surface of the developer roller 3.

As shown in FIGS. 3A and 3B, the first and second sets of primary electrodes 3*a* and 3*b* extend parallel along a longitudinal axis of the developer roller 3 and alternate with each other to form an interdigitated pattern on the roller surface. During operation, the voltage source 25 applies a first periodic voltage $V_A$ to all the first set of electrodes 3*a* and a second periodic voltage $V_B$ to all the second set of electrodes 3*b*, through the stationary electrodes held in sliding contact with the end flanges 6*a* and 6*b*. Thus, every other electrode in the interdigitated pattern is at the same potential, which periodically oscillates to generate an oscillating electric field on the developer roller 3.

Figure 4:
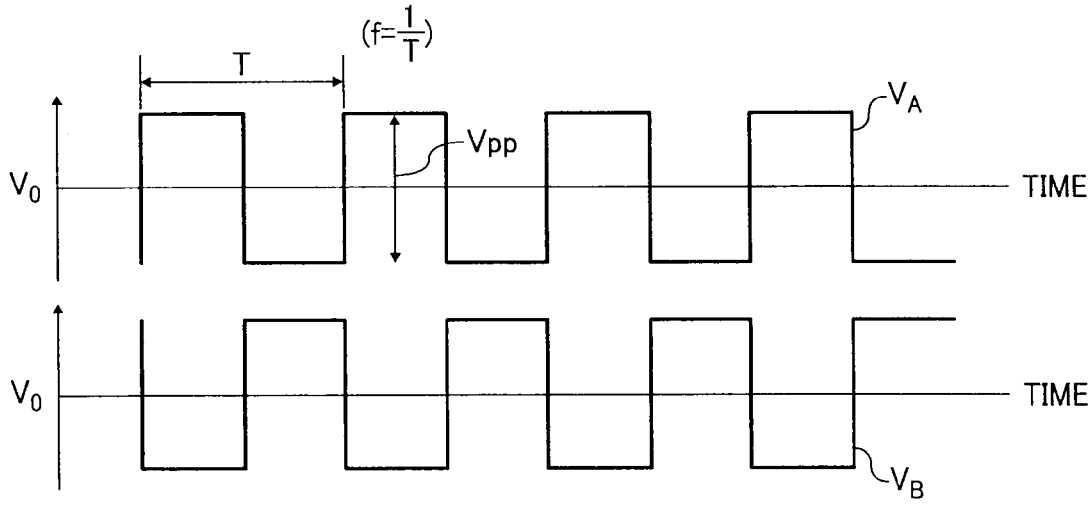
FIG. 4 shows example waveforms of periodic voltages for application to electrodes on the developer roller of FIG. 2, each plotted against time.

FIG. 4 shows example waveforms of the periodic voltages $V_A$ and $V_B$ each plotted against time.

As shown in FIG. 4, the voltages $V_A$ and $V_B$ may be rectangular pulse signals oscillating in antiphase with each other at a given period T (or frequency f=1/T), a given peak-to-peak voltage Vpp, and a common average level $V_0$ per unit time. The time average $V_0$ has a polarity similar to that of charged toner particles (i.e., negative in the present embodiment) and a potential between those of charged and non-charged areas of the photoconductive surface. Thus, simultaneously applying the periodic voltages $V_A$ and $V_B$ maintains the primary electrodes 3*a* and 3*b* both at an average polarity similar to that of charged toner and an average potential between those of image and non-image areas of the photoconductive surface.

Further, application of the antiphase voltages $V_A$ and $V_B$ to the electrodes 3*a* and 3*b* develops a periodically oscillating electric field on the circumferential surface of the developer roller 3. Upon loading onto the developer roller 3, toner particles periodically hop or move back and forth in parabolic orbits between neighboring electrodes 3*a* and 3*b* along electric field lines of the oscillating electric field to form a "flare" or aerosol cloud of periodically hopping toner particles around the roller surface.

When delivered to the development zone, the toner flare rises close to an electrostatic latent image recorded on the photoconductive surface, in which toner particles approach either image areas or background areas at the apogee of their parabolic orbits. Consequently, those particles that approach the image areas deviate from their original orbits due to electrostatic attraction thereto and adhere to the photoconductive surface to develop the latent image, while those approaching the background areas follow their parabolic orbits back to the roller surface.

Such transfer of toner across the development gap does not require a high voltage to be applied between image and non-image areas, since hopping toner is free from consistent adhesion to the roller surface and readily transfers when attracted by an electrostatic latent image. This provides an extremely low-energy design of the development device 1, particularly when compared to single-component or two-component development processes which transfer toner across a development gap primarily based on an electrical bias between an electrostatic latent image and a developer roller or sleeve. In addition, the hopping configuration is superior in its readiness in removing unused toner from the developer roller for reloading new toner for a subsequent development cycle.

Figure 5:
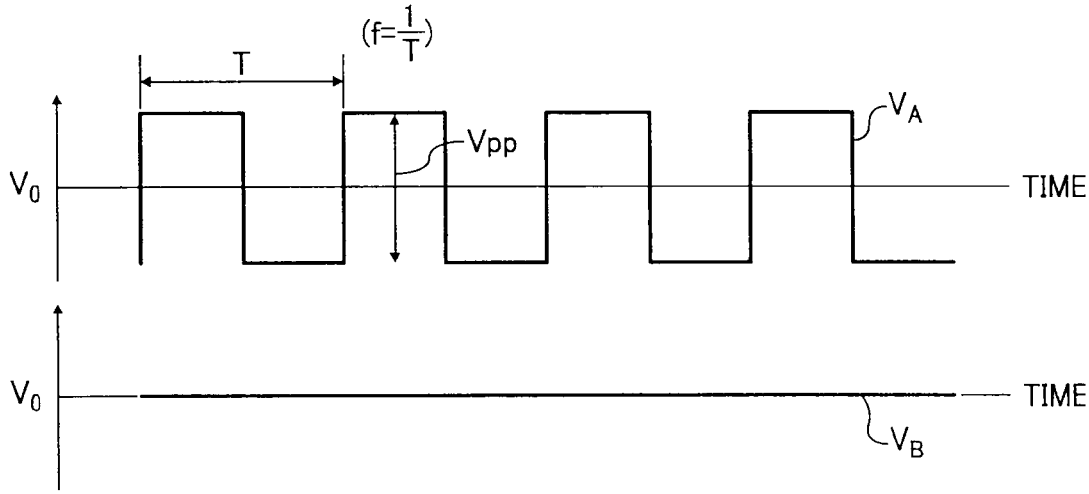
FIG. 5 shows other example waveforms of periodic voltages for application to electrodes on the developer roller of FIG. 2, each plotted against time.

Although the embodiment described above uses the rectangular pulse voltages $V_A$ and $V_B$, any other periodic signals, such as sinusoidal or triangular waveforms, may also be used to generate an oscillating electric field on the roller surface. However, the rectangular pulse signal is preferable since the rectangular pulses rapidly switch their polarity to impart high electrostatic forces to toner particles under the developed oscillating field. Moreover, as shown in FIG. 5, it is also possible to use a combination of a periodic pulse voltage and a direct current (DC) voltage with a common average level as the voltages $V_A$ and $V_B$.

Referring back to FIGS. 3A and 3B, the primary electrodes 3*a* and 3*b* are thin conductive strips disposed at a given constant pitch or sum of width W and spacing S on an insulating substrate 3*c* with a top surface thereof coated with a protective layer 3*d* of insulating material.

Specifically, the primary electrodes 3*a* and 3*b* are formed of conductive material, such as aluminum, copper, nickel, nickel-chromium alloys, etc., using photolithography or any suitable patterning technique with a thickness ranging from approximately 0.1 μm to approximately 10 μm, and preferably from approximately 0.5 μm to approximately 2.0 μm.

The substrate 3*c* may be an insulating substrate formed of resin or similar material, or a conductive substrate with a top coating of insulating material, e.g., a stainless steel base coated with silicon dioxide.

The protective layer 3*d* may be formed of suitable oxide or nitride compounds, such as silicon dioxide ($SiO_2$), barium titanate ($BaTiO_2$), titanium dioxide ($TiO_2$), titanium oxide ($TiO_4$), silicon oxynitride (SiON), boron nitride (BN), titanium nitride (TiN), and tantalum pentoxide ($Ta_2O_5$), as well as materials used as coating on carrier particles in two-component developer, such as zirconium dioxide, silicone resins, or the like. A layer of organic insulating material, such as polycarbonate, or an inorganic insulating layer with an organic insulator coating, may also be used as the protective layer 3*d*. The protective layer 3*d* may have a thickness ranging from approximately 0.5 to approximately 10 μm, preferably from approximately 0.5 to approximately 3 μm. The protective layer 3*d*, deposited on and between the primary electrodes 3*a* and 3*b*, prevents electrical charges from flowing to toner particles from the electrodes 3*a* and 3*b*, which would result if the primary electrodes come into direct contact with toner surrounding the roller surface.

In addition, the developer roller 3 is constructed on a cylindrical body with a length scaled to match or exceed the size of recording sheets used in the image forming apparatus, e.g., A4 copy sheets with a width of 21 centimeters and a length of 30 centimeters.

To construct the developer roller 3, it is important to properly set the electrode width W, the electrode spacing S, the $V_A$ and $V_B$, and the thickness of the protective layer 3*d*, including the relation between these parameters affecting performance of the hopping development mechanism.

Firstly, the width W of the primary electrode influences the amount of toner hopping in a parabolic path as well as the electrostatic force driving the hopping toner.

Specifically, on the circumferential surface of the developer roller 3, each set of neighboring electrodes 3*a* and 3*b* generates electric field lines of different shapes therebetween. For example, an electric field line emanating from the edge of an electrode extends substantially parallel to the roller surface to connect to the edge of an adjacent electrode, while one originating from an approximate center of an electrode curves in a parabolic shape to connect to an adjacent electrode. As a result, toner particles present between two neighboring electrodes move laterally therebetween upon application of an oscillating electric field, while those resting above an electrode move in a parabolic path to come close to the photoconductive surface. Since a wider electrode can have an increased number of toner particles deposited thereon, increasing the electrode width W leads to an increased amount of toner moving toward the photoconductive surface.

On the other hand, with a given voltage applied to the primary electrodes, an electric field acting on each particle located above an electrode decreases as the width of the electrode increases. In this regard, excessively increasing the electrode width W leads to decreased mobility of toner particles toward the photoconductive surface.

Thus, the electrode width W should be set to a reasonable value that allows an increased amount of toner to move parabolically while ensuring that a sufficient electric field is exerted on each particle. For example, the width W may fall within 1 to 20 times an average particle diameter of toner.

Secondly, the spacing S between the primary electrodes affects the speed of toner hopping on the developer roller.

It is known that, with applied voltage and electrode width held constant, the smaller the spacing S between neighboring electrodes, the stronger the electric field inducing motion of toner particles. This results in an increased initial speed at which the toner particles fly from the electrodes toward the photoconductive surface. Although it is desirable that the toner particles move fast over the roller surface, excessively fast particle motion results in a reduced period of time during which the particles are in midair, that is, an increased period of time during which the particles rest between flights along the roller surface.

Although reducing frequency of the applied voltage can increase the duration of toner flight to compensate for the effects of a reduced electrode gap, it is desirable to maintain the spacing S in a reasonable range where such compensation is not feasible. For example, the spacing S may fall within 1 to 20 times an average particle diameter of toner.

In addition, the thickness of the protective layer 3*d* also affects the transfer efficiency of toner to the photoconductive surface insofar as it is known that a thicker protective layer results in a reduced electric force driving toner particles vertically upward on the roller surface.

The following describes fabrication of the developer roller 3, including deposition of an electrode pattern on a flexible sheet-like substrate and subsequent winding of the patterned substrate around a cylindrical core.

Initially, a layer of conductive material, such as copper, aluminum, nickel-chromium alloy, or the like, with a thickness of approximately 0.1 to approximately 0.3 μm is formed on the surface of a polyimide substrate approximately 20 to approximately 100 μm thick. With the width of the polyimide substrate being on the order of 30 to 60 cm, such a conductive layer may be formed through roll-to-roll processing using a vapor deposition technique, such as sputtering, ion plating, chemical vapor deposition, ion beam assisted deposition, or the like. Alternatively, the conductive layer may be formed through electrodeposition, such as an electroless deposition process that involves successively immersing a polyimide substrate in a series of tin chloride, palladium chloride, and nickel chloride bathes to obtain a primer coating, followed by electrolytically plating the primed substrate with a nickel coating approximately 1 to approximately 3 μm thick.

It is preferable to provide an intermediate layer of chromium between the conductive layer and polyimide substrate using sputtering or other suitable processes, such as plasma treatment or priming treatment, to ensure good bonding of the conductive material on the substrate.

The conductive layer thus formed on the polyimide substrate is then patterned through photolithographic processes, including photoresist application, exposure, etching, etc., resulting in an interdigitated pattern of multiple electrodes deposited on the substrate. With the thickness of the conductive layer being on the order of 0.1 to 3 μm, the resulting pattern of electrodes may have a close, even spacing of several microns to several tens of microns.

After obtaining the interdigitated electrodes, the polyimide substrate is covered by a protective layer of an insulating material, such as $SiO_2$, $BaTiO_2$, $TiO_2$, zirconium dioxide, silicone resin, or any substance used as coating on carrier particles in two-component developer, with a thickness ranging from approximately 0.5 to approximately 2 μm using sputtering or other suitable deposition technique. For example, the process may be carried out by first applying polyimide to a thickness ranging from approximately 2 to approximately 5 μm with a roll coater or other coating machine, and subsequently baking the coated surface. Preferably, such a baked polyimide layer may be reinforced by sputter depositing silicon dioxide or other inorganic insulating material to the polyimide surface, and finishing the top surface with a coating of polycarbonate or other organic insulating material.

Subsequently, the substrate is wrapped and glued around a cylindrical core to obtain a developer roller.

Further, instead of using a polyimide sheet, the roller substrate may be prepared from a sheet of metal, such as stainless steel, aluminum, or the like. In such cases, the fabrication begins by applying a polyimide coating approximately 5 μm to approximately 100 μm thick to a metal sheet approximately 20 to approximately 30 μm thick using a roll coater, and subsequently forming an insulating top layer of polyimide, for example, by baking the polyimide surface firstly at 150° C. for 30 minutes and subsequently at 350° C. for 60 minutes.

Thereafter, the coated metal substrate undergoes photolithographic processes to obtain a pattern of multiple electrodes thereon, followed by application of polyimide to obtain a protective layer over the patterned surface. In case the protective layer has an uneven surface due to gaps between the electrodes lying on the metal substrate, it is desirable to planarize the substrate surface by applying a polyimide or polyurethane material of a viscosity ranging from approximately 50 to approximately 10,000 centipoise (cP), preferably, from approximately 100 to approximately 300 cP with a spin coater, and leaving the substrate to stand until the coated surface becomes smooth owing to its surface tension.

Still further, the deposition of multiple electrodes may be carried out using techniques other than photolithographically patterning a conductive layer deposited on a substrate. Such alternative techniques include using a laser beam to pattern a conductive layer, or drawing an electrode pattern on a substrate with conductive ink through screen printing or inkjet printing processes.

The following describes characteristic features of the hopping development device 1 according to this patent specification.

Figure 6:
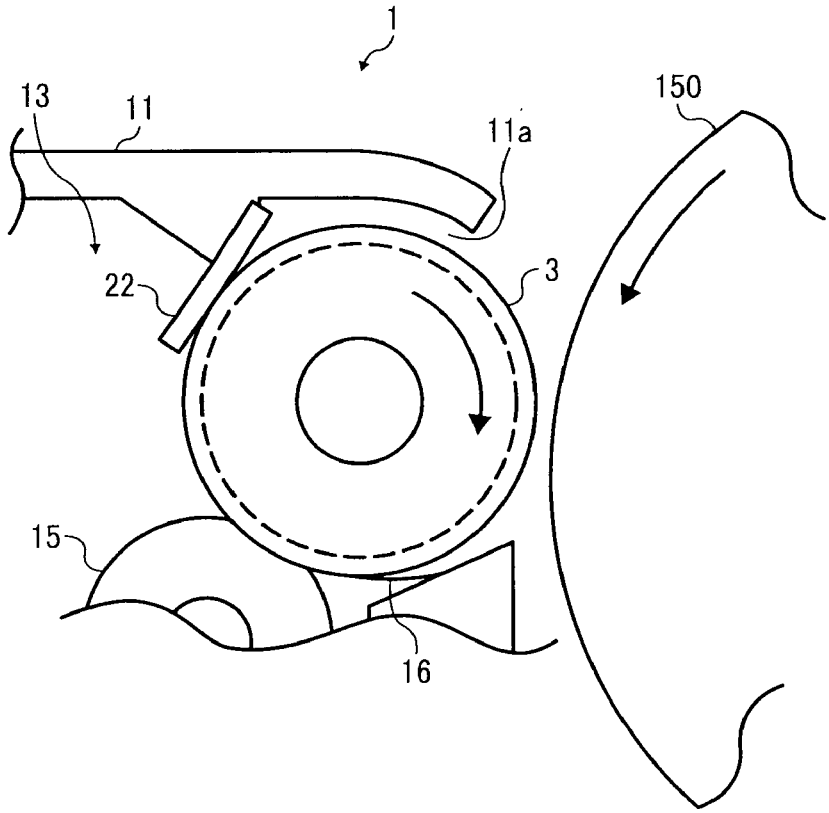
FIG. 6 is an expanded cross-sectional view illustrating the developer roller of FIG. 2, equipped with a secondary electrode according to one embodiment of this patent specification.

FIG. 6 is an expanded cross-sectional view illustrating the developer roller 3 at the end opening 11*a* of the developer housing 11.

As shown in FIG. 6, the development device 1 includes a generally flexible, cantilevered sealing blade 16 in addition to the housing 11, the developer roller 3, the loading roller 15, and the metering blade 22. The sealing blade 16 has one edge fixed on a lower, downstream edge of the opening 11*a*, and another edge pointing downstream from the fixed edge in the direction of rotation of the developer roller 3. The free edge of the sealing blade 16 contacts the developer roller 3 at a relatively low contact pressure, which loosely seals a clearance between the roller surface and the lower edge of the opening 11*a* to prevent toner from leaking out of the developer chamber 13.

As the developer roller 3 rotates, a supply of toner advances first to the metering zone and then to the developer zone, while hopping on the roller surface under an oscillating electric field generated by the primary electrodes 3*a* and 3*b*.

In the metering zone, the metering blade 22 and the developer roller 3 regulates the flow of toner particles passing therebetween, so as to maintain a constant amount of toner per unit area of the roller surface for entry into the development zone. In the development zone, some of the hopping toner particles are used to develop an electrostatic latent image on the photoconductor drum 150, while others leave the development zone without being used and return to the developer chamber 13 for removal from or retention on the developer roller 3.

One problem encountered by a conventional hopping development device having a sealing blade similar to that depicted in FIG. 6 is that the sealing blade interferes with residual toner returning to a developer chamber. That is, the sealing blade directly contacting a developer roller removes unused toner from the roller surface before that toner can enter the developer chamber. Such undesirable removal can occur even with a flexible sealing blade contacting the roller surface at a relatively low pressure, since hopping toner readily migrates from the developer roller upon directly contacting the sealing blade. This results in unused toner particles failing to return to the developer chamber and instead accumulating on the surface of the sealing blade and eventually spreading out to contaminate areas adjacent to the development device.

Figure 7:
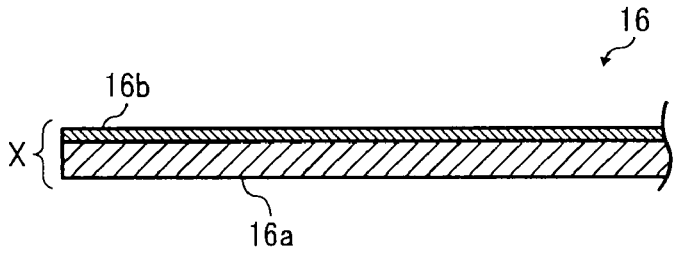
FIG. 7 shows in cross section the secondary electrode of FIG. 6.

To overcome such a problem, the development device 1 according to this patent specification has a secondary electrode X facing a contact area of the roller surface closest to or in contact with the sealing blade 16 to generate a secondary electric field that forces toner toward the roller surface to counteract an electrostatic force repelling toner from the roller surface. FIG. 7 shows in cross section the secondary electrode X according to one embodiment of this patent specification.

As shown in FIG. 7, the secondary electrode X is integrated into the sealing blade 16, with a first layer 16*a* of conductive material such as stainless steel, and a second layer 16*b* of insulating material such as fluoroplastic overlying the conductive layer 16*a*. While not depicted in the drawing, the secondary electrode X has a voltage source to energize the conductive layer 16*a*.

Referring back to FIG. 6, the sealing blade or secondary electrode X is installed with the insulating layer 16*b* directly contacting the roller surface and the conductive layer 16*a* facing the roller surface through the insulting layer 16*b* at least in a certain contact area. During operation, the conductive layer 16*a* is energized with a given bias voltage $V_X$ having a polarity similar to that of the average level $V_0$ of the periodic $V_A$ and $V_B$, and an average potential greater than that of the average voltage $V_0$ in absolute value. For example, given that the voltages $V_A$ and $V_B$ each has an average potential $V_0$ of −300 V, a frequency of 1 kilohertz (kHz), and a peak-to-peak amplitude Vpp of 500 V, the bias voltage $V_X$ may be a rectangular pulse voltage with an average potential of −350 V, a frequency of 2 kHz, and a peak-to-peak amplitude of 600 V.

When energized, the conductive layer 16*a* generates the secondary electric field to direct toner toward the developer roller 3 from the electrode blade 16. More specifically, the secondary electric field forces toner against the developer roller 3, so that it can pass through the sealing blade 16 by following the moving surface of the developer roller 3. Such electrostatic force acts not only on toner retained in the contact area between the roller outermost layer 3*d* and the blade outermost layer 16*b*, but also on toner resting on the sealing blade 16 immediately upstream of the contacting surfaces of the developer roller 3 and the sealing blade 16. This allows toner particles to swiftly enter the developer housing 11 without being removed prematurely by the sealing blade 16 at the contact area.

Thus, according to the embodiment described in FIG. 6, the development device 1 enables hopping toner to pass through the edge clearance of the opening in the developer housing without being prematurely removed by the sealing blade. This enhances delivery rate of hopping toner from the developer zone and prevents accumulation of unused toner on the sealing blade and resultant contamination around the developer housing.

Additionally, in the present embodiment, the metering blade 22 for metering the quantity of toner on the developer roller 3 serves to seal clearance at an upper edge of the opening 11*a*. This eliminates the need to provide a dedicated sealing member at the upper edge of the opening, thus enabling use of a simple and compact structure for the development device 1. Alternatively, in configurations having no metering blade and no protection against toner leakage, it is preferable to seal the upstream clearance with a sealing blade combined with a secondary electrode similar to those depicted above.

Further, it is possible to use a direct current (DC) voltage as the bias voltage $V_X$ for application to the secondary electrode X, instead of a rectangular pulse signal used in the embodiment described above. However, pulse voltage is desirable in terms of the impact on toner migrating onto the sealing blade upstream of the contacting edge, which effectively detaches toner from the sealing blade and directs it toward the roller surface.

Figure 8:
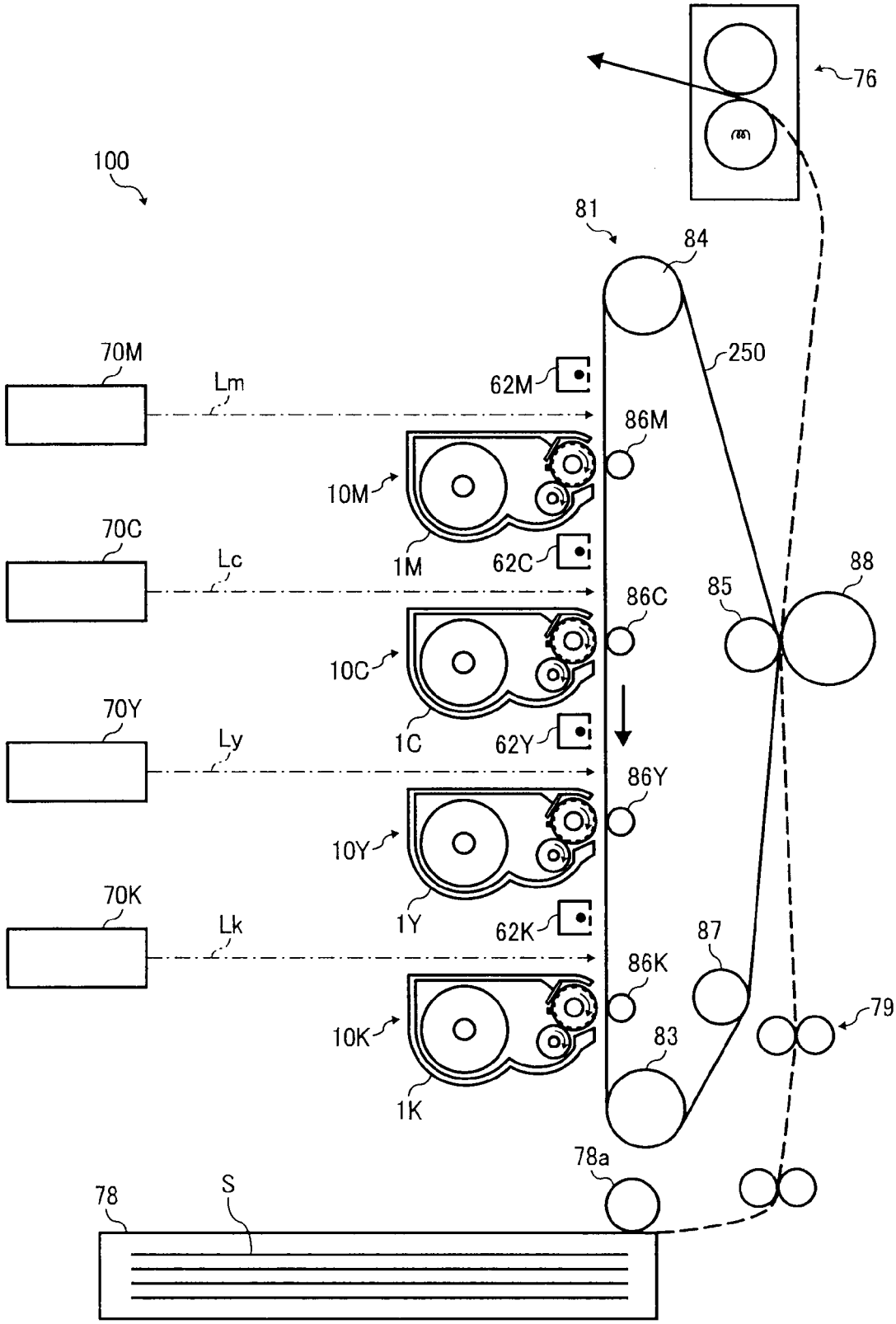
FIG. 8 schematically illustrates an image forming apparatus incorporating the development device of FIG. 1 according to one embodiment of this patent specification.

FIG. 8 schematically illustrates an image forming apparatus 100 incorporating the development device 1 according to one embodiment of this patent specification.

As shown in FIG. 8, the image forming apparatus 100 includes a photoconductive belt unit 81, four imaging stations 10M, 10C, 10Y, and 10K, and four exposure units 70M, 70C, 70Y, and 70K, as well as a feed roller 78*a*, a pair of registration rollers 79, a transfer roller 88 with a voltage source, not shown, defining a sheet feed path to transport a recording sheet S from a sheet tray 78 toward a fixing unit 76.

The image forming apparatus 100 forms a full-color image by superimposing one atop another toner images of different colors. In this patent specification, the suffix letters assigned to reference numerals each refers to components associated with a particular toner color used in the image forming apparatus 100, where "Y" denotes yellow, "C" for cyan, "M" for magenta, and "K" for black. Thus, components marked with the same suffix will be regarded as elements associated with each other, while components marked with the same numeric character will be regarded as equivalent and/or corresponding elements. These suffixes will be omitted for ease of illustration and explanation where the statements presented are equally applicable to all the components designated by the same reference number.

In the image forming apparatus 100, the belt unit 81 includes an endless photoconductor belt 250 running vertically rather than horizontally, with an inner surface supported by a motorized drive roller 83 at the bottom and a tension roller 84 at the top, as well as a driven pulley 87 and a backup roller 85 between the bottom and top rollers 83 and 84. Also included are a series of rollers 86M, 86C, 86Y, and 86K located at one side of the belt unit 81 in alignment with each other to define a generally vertical travel path along which the photoconductive belt 250 travels downward in accordance with the drive roller 83 rotating counterclockwise in the drawing.

The imaging stations 10M, 10C, 10Y, and 10K include the development devices 1M, 1C, 1Y, and 1K, and charging devices or corona chargers 62M, 62C, 62Y, and 62K. The imaging stations 10M, 10C, 10Y, and 10K are vertically arranged with the development devices 1M, 1C, 1Y, and 1K aligned with each other along the belt travel path. In each imaging station 10, the development device 1 forms a development gap with a portion of the photoconductive belt 250 supported by the roller 86. The charging device 62 is located above the development device 1 so as to face the photoconductive belt 250 immediately upstream of the development gap.

Although not visible in the drawing, each imaging station has a holder to hold together the development device 1 and the charging device 62, whereby they are integrated into a single process unit detachably mounted in the image forming apparatus 100.

The exposure units 70 are located beside the associated imaging stations 10 to vertically align with each other. Each exposure unit 70 includes a semiconductor laser to emit a laser beam L representing image data processed by an external computer or scanner, as well as an optical assembly including a polygon mirror and a variety of lenses and reflecting mirrors to transmit the laser beam L to scan the surface of the photoconductive belt 250 in the dark immediately upstream of the development gap. Alternatively, the exposure unit 70 may be constructed on a light emitting diode (LED) array instead of the semiconductor laser device.

During operation, the belt unit 81 successively passes the photoconductive belt 250 through the imaging stations 10M, 10C, 10Y, and 10K to form a full-color toner image on the photoconductive surface.

First, in the magenta imaging station 10M, the charging device 62M uniformly charges the photoconductive belt 250 (e.g., to a negative potential), followed by the exposure unit 70M irradiating the charged areas with the laser beam Lm representing magenta image data. An electrostatic latent image thus formed on the photoconductive belt 250 enters the development gap, in which the development device 1M develops a visible toner image with hopping magenta toner particles in the manner described earlier. After development, the magenta toner image advances to the cyan imaging station 10C.

In the cyan imaging station 10C, an imaging cycle similar to that performed in the magenta imaging station 10M is repeated with cyan toner and image data, starting from uniformly charging the photoconductive surface bearing the magenta toned image thereon, followed by exposure and development processes. This results in a layered color image with magenta and cyan color layers superimposed one atop another, containing secondary color areas where the two primary layers overlap each other. The double-layered toner image thus formed advances to the yellow imaging station 10Y.

In the yellow imaging station 10Y, an imaging cycle similar to that performed in the magenta imaging station 10M is repeated with yellow toner and image data, starting from uniformly charging the photoconductive surface bearing the composite color image thereon, followed by exposure and development processes. This results in a layered color image with yellow, magenta, and cyan color layers superimposed one atop another, containing tertiary and/or secondary color areas where all or two of the primary layers overlap each other. Then, the triple-layered toner image advances to the black imaging station 10K.

In the black imaging station 10K, an imaging cycle similar to that performed in the magenta imaging station 10M is repeated with black toner and image data, starting from uniformly charging the photoconductive surface bearing the composite color image thereon, followed by exposure and development processes. This results in a layered color image with black, yellow, magenta, and cyan color layers superimposed one atop another, containing black color areas in addition to the previously formed tertiary and/or secondary color areas.

After leaving the black imaging station 70K, the final toner image passes through the bottom support roller 83, and advances upward to a transfer nip defined between the backup roller 85 and the transfer roller 88.

Meanwhile, in the sheet feed path, the feed roller 78*a* rotates to output a recoding sheet S from the sheet feed tray 78. The registration rollers 79, continuously rotating downstream of the tray 78, stops as a leading edge of the sheet S enters a nip defined therebetween, and resumes rotation to forward the sheet S in accordance with the toner image moving toward the transfer nip, so that the sheet S meets the image when reaching the transfer nip.

At the transfer nip, the full-color toner image is transferred from the photoconductive belt 250 to the recording sheet supported on the transfer roller 88, with a pressure and an electric field applied between the transfer roller 88 and the backup roller 85 electrically biased relative to each other. The multicolor image thus formed on the recording sheet S faithfully reproduces the original image data when the recording sheet S used is white in color. Thereafter, the recording sheet S is forwarded to the fixing unit 76, which fixes the toner image in place, and then to outside the image forming apparatus for subsequent pickup by an operator.

Thus, the image forming apparatus 100 forms a multicolor image by depositing layers of different colors one atop another on a single photoconductive member, in contrast to a tandem color printer that deposits sub-images of different colors on multiple photoconductors to form a multicolor image by superimposing the sub-images one atop another on an intermediate transfer member.

The image forming apparatus 100 is superior to the tandem architecture in that it is free from misalignment of colors resulting from imprecise transfer of sub-images from the multiple photoconductive surfaces to the intermediate transfer member. Further, spacing the developer roller and the photoconductive surface away from each other at the development gap prevents interference between a developer roller and a previously developed toner layer, which would cause retransfer of toner to the developer roller or other undesirable damages, such as scavenging and contamination, on the resulting image. Hence, the image forming apparatus with the hopping development mechanism can perform high quality image formation for extended periods of time without image degradation.

In further embodiments, the development device 1 according to this patent specification has a secondary electrode Y facing the roller surface upstream from a contact area between the sealing member and the roller surface to generate a secondary electric field to counteract both the sealing member interfering with the toner passing therethrough as well as an electrostatic force of the primary electric field repelling the toner from the roller surface.

Figure 9:
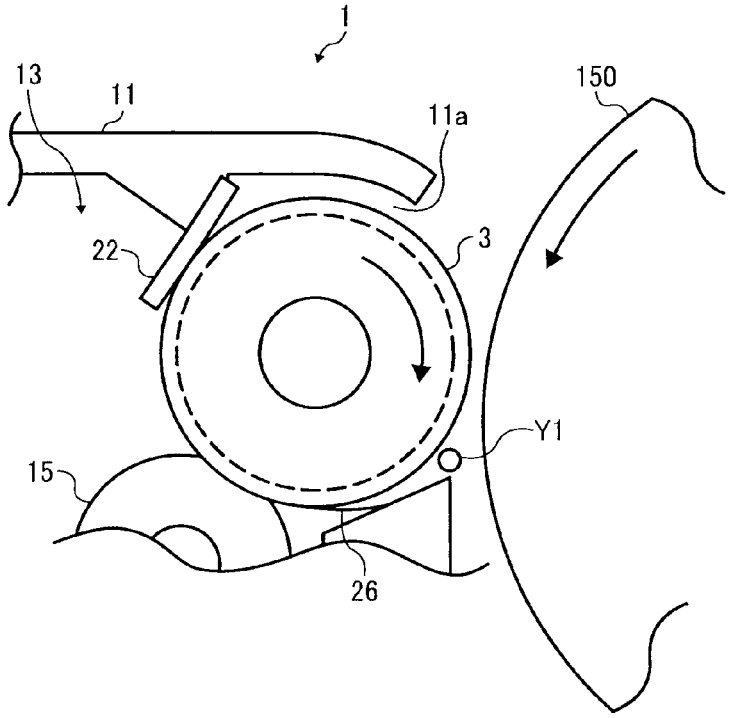
FIG. 9 is an expanded view schematically illustrating the developer roller of FIG. 2, equipped with a secondary electrode according to another embodiment of this patent specification.

FIG. 9 is an expanded view schematically illustrating the developer roller 3 at the opening 11*a* of the developer housing 11 according to another embodiment of this patent specification.

As shown in FIG. 9, this embodiment is similar to that depicted in FIG. 6, except that the development device 1 has a secondary electrode or wire Y1 independent of a sealing blade 26 formed of an insulating material, instead of the secondary electrode X integrated into the conductive sealing blade 16. Although not depicted in the drawing, the secondary electrode Y1 has a voltage source to energize the secondary electrode Y1.

Specifically, the secondary electrode Y1 is a thin conductive wire with a diameter of approximately 60 μm, extending adjacent to the lower edge of the opening 11*a* parallel to the longitudinal axis of the developer roller 3, and spaced approximately 50 μm away from the surface of the roller 3 immediately upstream of the contacting edge of the sealing blade 26.

During operation, the voltage source energizes the conductive wire with a bias voltage $V_Y$ similar to the bias voltage $V_X$. When energized, the conductive wire Y1 generates the secondary electric field to direct toner toward the developer roller 3 from the sealing blade 26. More specifically, the secondary electric field detaches toner from the surface of the sealing blade 26 while preventing toner from flowing away from between the sealing blade 26 and the developer roller 3 beyond the electrode wire Y1. Should toner migrate onto the sealing blade 26, the secondary electric field detaches the migrating toner from the blade 26 and ultimately forces it against the roller surface. This results in a certain amount of toner builds up between the sealing blade 26 and the developer roller 3, which eventually passes through the sealing blade 26 by following the moving surface of the developer roller 3.

Figure 10:
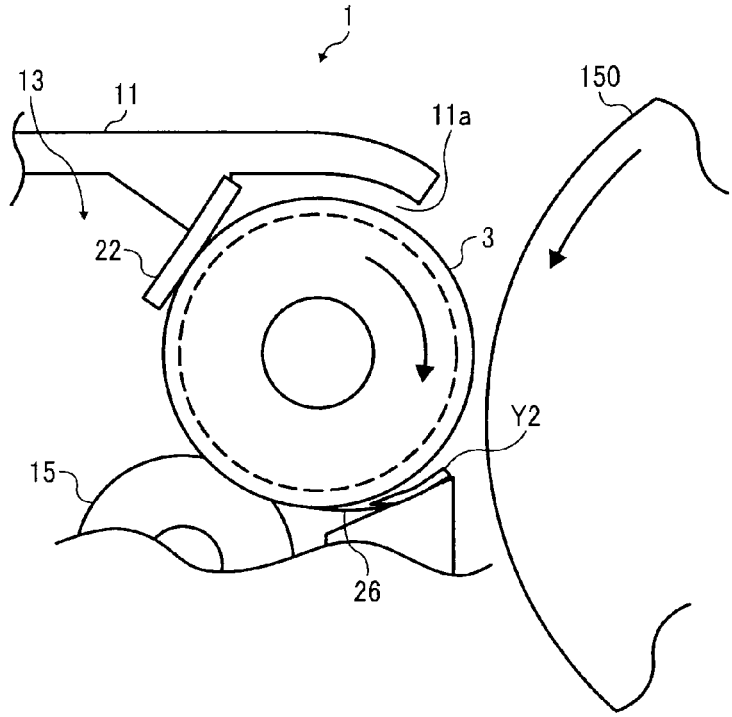
FIG. 10 is an expanded view schematically illustrating the developer roller of FIG. 2, equipped with a secondary electrode according to still another embodiment of this patent specification.

FIG. 10 is an expanded view schematically illustrating the developer roller 3 at the end opening 11*a* of the developer housing 11 according to still another embodiment of this patent specification.

As shown in FIG. 10, this embodiment is similar to that depicted in FIG. 9, except that the development device 1 has a secondary electrode Y2 in the form of a conductive plate, instead of the conductive wire Y1.

Specifically, the secondary electrode Y2 is a plate of conductive material with a width of approximately 2 millimeters, affixed to the fixed edge of the sealing blade 26 along the downstream edge of the opening 11*a*, and spaced approximately 50 μm away from the surface of the roller 3 immediately upstream of the contacting edge of the sealing blade 26. When energized with the bias voltage $V_Y$, the conductive plate Y2 generates the secondary electric field to direct toner toward the developer roller 3 from the sealing blade 26 in the manner depicted in FIG. 9.

Thus, according to the embodiments described in FIGS. 9 and 10, the development device 1 with the secondary electrode independent of the sealing blade enables hopping toner to pass through the edge clearance of the opening in the developer housing, and prevents excessive accumulation of toner on the sealing blade which would result in contamination around the developer housing. The thin wire electrode Y1 is advantageous in that it can be mounted in the narrow space between the roller surface and the lower edge of the opening 11*a*, while its extreme thinness results in a relatively small electric field generated therewith. By contrast, the plate electrode Y2 can generate a relatively large electric field owing to the large surface area opposing the roller surface, leading to an enhanced efficiency in regulating the flow of toner along the roller surface.

In still further embodiments, the development device 1 according to this patent specification uses a developer roller with an alternating pattern of multiple electrodes in combination with a voltage source applying a direct current (DC) voltage to at least one of the multiple electrodes closest to the sealing blade to counteract an electrostatic force of the electric field repelling the toner from the roller surface.

Figure 11:
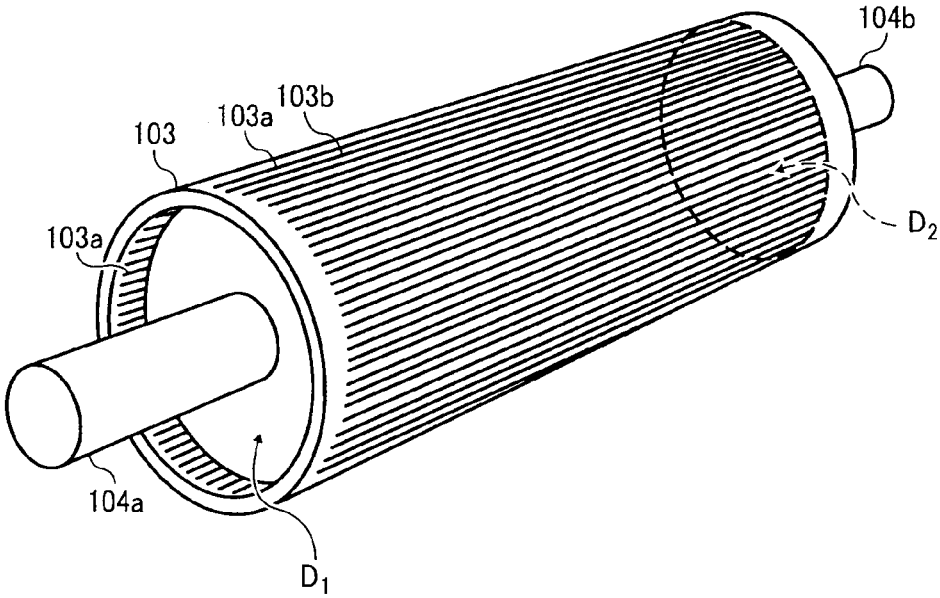
FIG. 11 is a perspective view schematically illustrating a developer roller used in the development device according to yet still another embodiment of this patent specification.

FIG. 11 is a perspective view schematically illustrating a developer roller 103 used in the development device 1 according to yet still another embodiment of this patent specification.

As shown in FIG. 11, the developer roller 103 has first and second sets of multiple electrodes 103*a* and 103*b* arranged around an outer circumferential surface thereof, and first and second axles 104*a* and 104*b*, as well as a first circular recess D1 defined at a first end of the roller 103, and a second circular recess D2 defined at a second end of the roller 103.

In addition, as depicted in FIG. 11, the developer roller 3 also includes a first set of major and minor stationary electrodes 50*a* and 51*a* accommodated in the first recess D1, a second set of major and minor stationary electrodes 50*b* and 51*b* accommodated in the second recess D2, coil springs 52 through 55 to retain the stationary electrodes in the respective recesses, and a voltage source 125 to energize the electrodes 103*a* and 103*b*.

The first and second sets of electrodes 103*a* and 103*b* extend parallel along the longitudinal axis of the roller 103 and alternate with each other on the circumferential surface of the roller 103. During operation, the voltage source 125 applies a first periodic voltage $V_A$ to the electrodes 103*a* and a second periodic voltage $V_B$ to the electrodes 103*b*. Thus, every other electrode in the alternating pattern is at the same potential, which periodically oscillates to generate an oscillating electric field on the developer roller 103 as in the embodiments described hereinabove.

The electrodes 103*a* and 103*b* are constructed on a cylindrical base 103*c* of acrylic resin or similar material with a surface coated with a protective layer 103*d* of insulating material. In contrast to the interdigitated electrodes 3*a* and 3*b*, the electrodes 103*a* and 103*b* in the present embodiment appear on the roller surface substantially across the entire width of the roller 103 but do not extend to the ends of the circumferential surface.

Figure 12A:
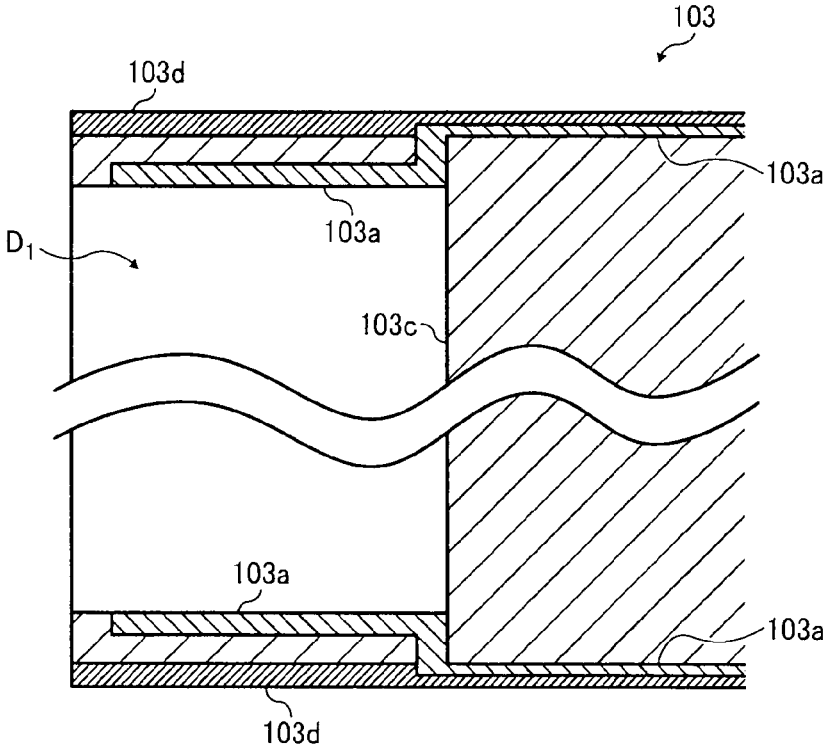
FIGS. 12A and 12B are partial cross-sectional views schematically illustrating a first end of the developer roller of FIG. 11 taken along alternating electrodes.
Figure 12B:
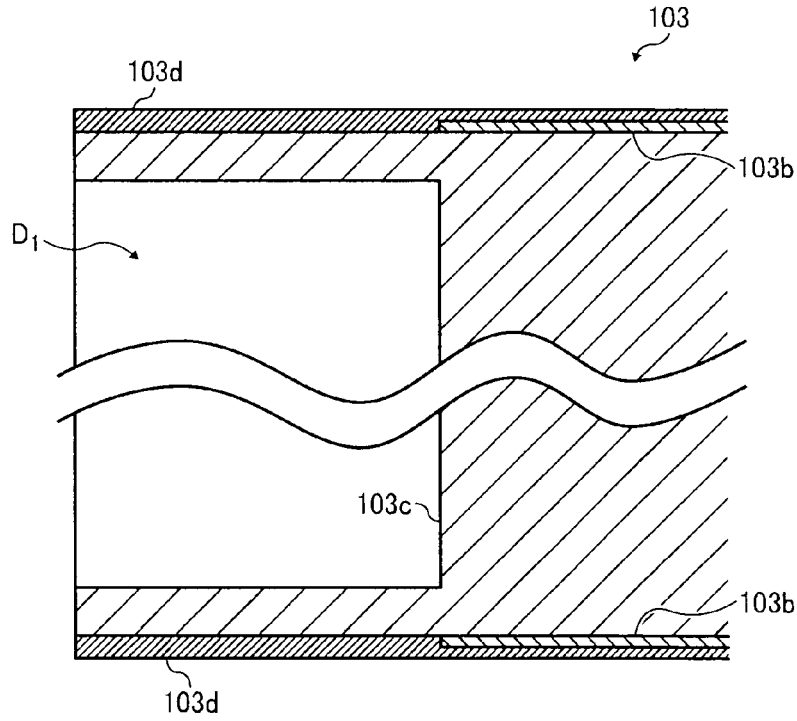

FIGS. 12A and 12B are partial cross-sectional views schematically illustrating the first end of the developer roller 103 taken along the electrode 103*a* and along the electrode 103*b*, respectively.

As shown in FIG. 12A, from center to the first end of the developer roller 103, each electrode 103*a* initially extends laterally along the exterior surface of the cylindrical base 103*c*, then vertically, and then again laterally along the interior surface of the end recess D1. Thus, the first set of electrodes 103*a*, generally covered with the protective layer 103*d* on the circumferential surface of the roller 103, is exposed at the inner circumference of the first recess D1.

By contrast, each electrode 103*b* extends only along the exterior surface of the cylindrical base 103*c* and terminates without connecting to the interior surface of the recess D1 at the first end as shown in FIG. 12B.

Figure 13A:
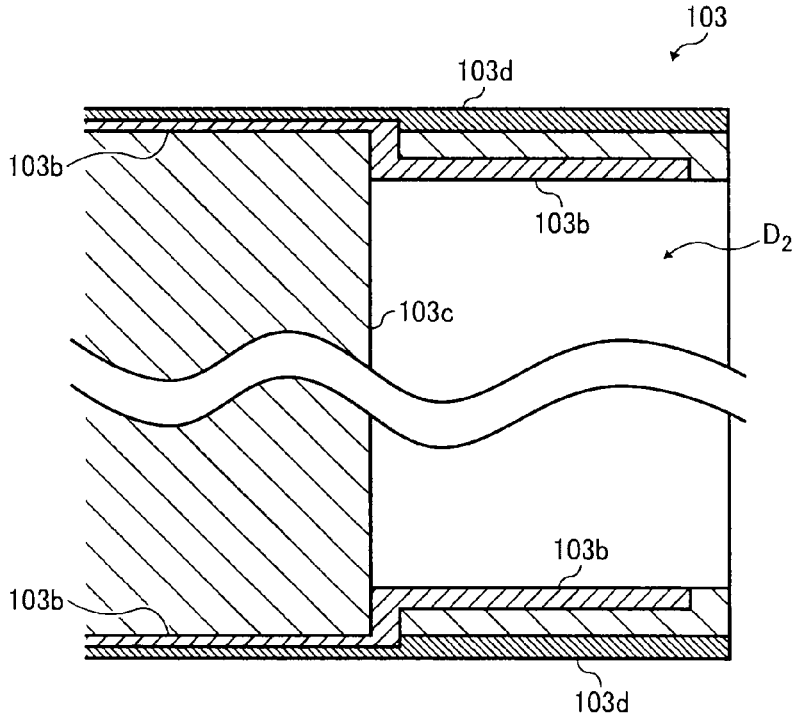
FIGS. 13A and 13B are partial cross-sectional views schematically illustrating a second end of the developer roller of FIG. 11 taken along alternating electrodes.
Figure 13B:
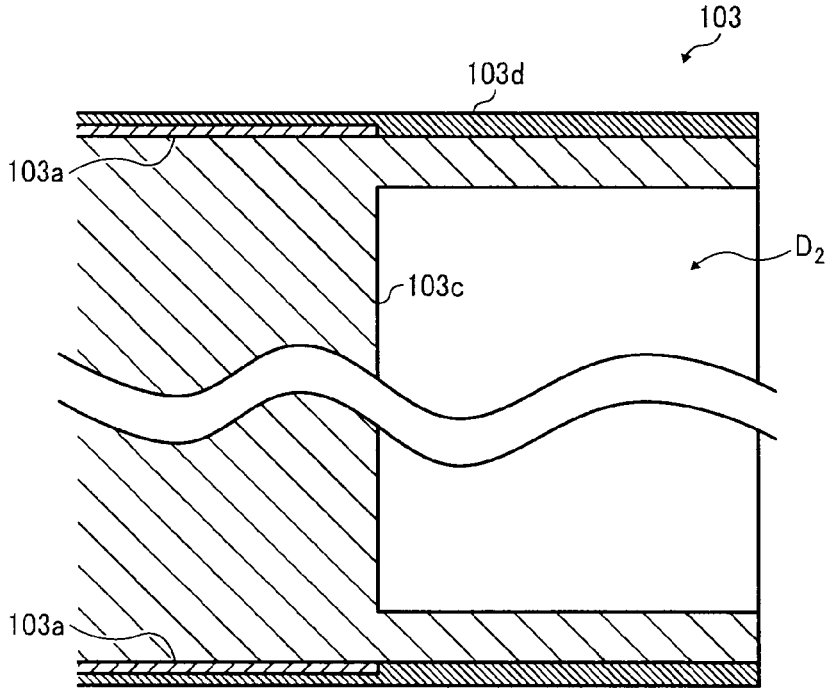

FIGS. 13A and 13B are partial cross-sectional views schematically illustrating the second end of the developer roller 103 taken along the electrode 103*b* and along the electrode 103*a*, respectively.

As shown in FIG. 13A, from center to the second end of the developer roller 103, each electrode 103*a* initially extends laterally along the exterior surface of the cylindrical base 103*c*, then vertically, and then again laterally along the interior surface of the end recess D2. Thus, the first set of electrodes 103*b*, generally covered with the protective layer 103*d* on the circumferential surface of the roller 103, are exposed at the inner circumference of the second recess D2.

By contrast, each electrode 103*a* extends only along the exterior surface of the cylindrical base 103*c* and terminates without connecting to the interior surface of the recess D2 at the second end as shown in FIG. 13B.

Figure 14:
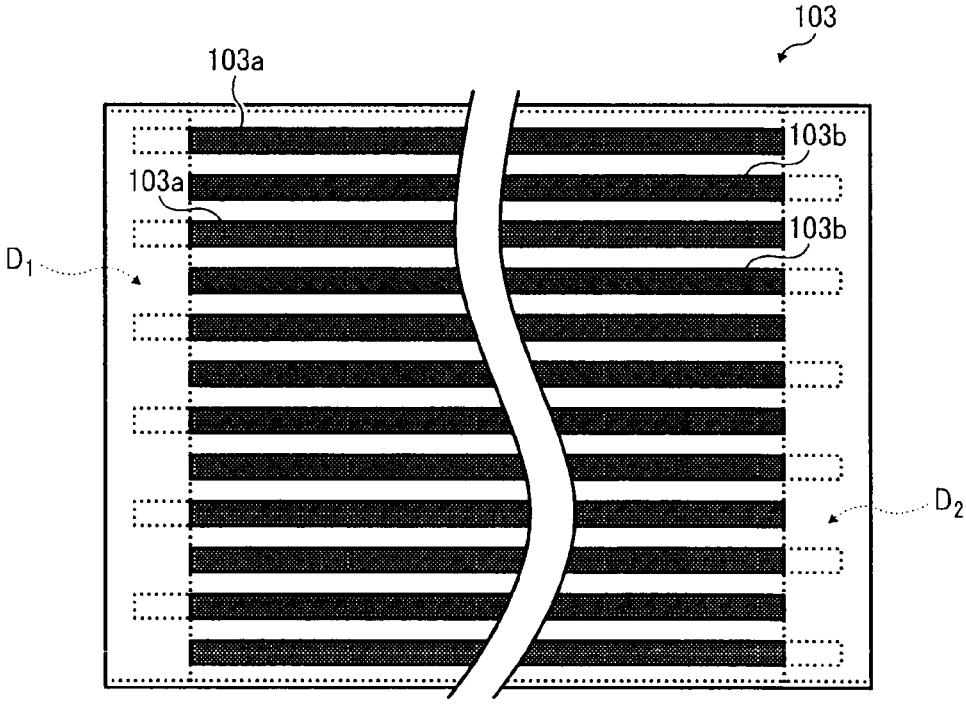
FIG. 14 is a top plan view schematically illustrating an arrangement of the alternating electrodes on the developer roller of FIG. 11.

FIG. 14 is a top plan view schematically illustrating an arrangement of the alternating electrodes 103*a* and 103*b* on the developer roller 103.

As shown in FIG. 14, at the first end of the roller 103, each electrode 103*a* penetrates into the cylindrical base 103*c* to terminate in the first recess D1, while each electrode 103*b* terminates on the surface of the cylindrical base 103*c*. Similarly, at the second end of the roller 103, each electrode 103*b* penetrates into the cylindrical base 103*c* to terminate in the second recess D2, while each electrode 103*a* terminates on the surface of the cylindrical base 103*c*.

Figure 15:
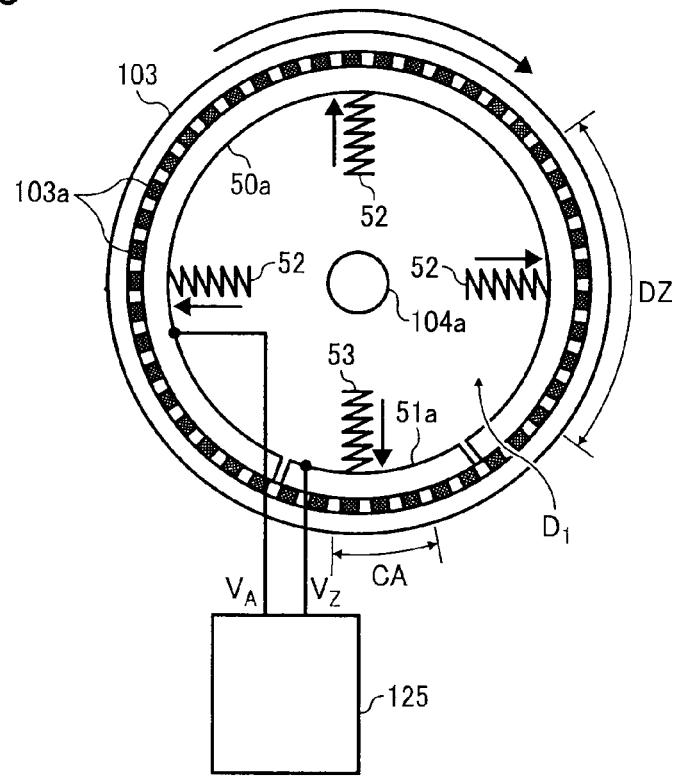
FIG. 15 is a side view schematically illustrating the developer roller of FIG. 11 from the first end.

FIG. 15 is a side view schematically illustrating the first end of the developer roller 103.

As shown in FIG. 15, the first set of electrodes 103*a* axially extend to the interior surface of the first recess D1 from the circumferential surface of the developer roller 103, which faces a photoconductive surface at a development zone DZ, and contacts a sealing blade 36, not shown, at a contact area CA. Along the inner circumference of the recess D1, the major and minor stationary electrodes 50*a* and 51*a* are disposed stationary relative to the roller 103 rotating around the axle 104*a* clockwise in the drawing.

More specifically, the major electrode 50*a* is held in sliding contact with the ends of the electrodes 103*a* passing the development zone DZ, with the coil springs 52 urging the electrode 50*a* against the circumference of the recess D1. Similarly, the minor electrode 51*a* is held in sliding contact with the ends of the electrodes 103*a* passing the contact area CA with the coil spring 53 urging the electrode 51*a* against the circumference of the recess D1.

During operation, the voltage source 125 applies the periodic pulse voltage $V_A$ to the major stationary electrode 50*a*, and a DC voltage $V_Z$ to the minor stationary electrode 51*a*. The DC voltage $V_Z$ is of a polarity opposite to that of charged toner particles (i.e., positive in the present embodiment). As a result, the electrodes 103*a* are energized with the pulse voltage $V_A$ when passing through the development zone DZ, and with the DC voltage $V_Z$ when passing through the contact area CA.

Figure 16:
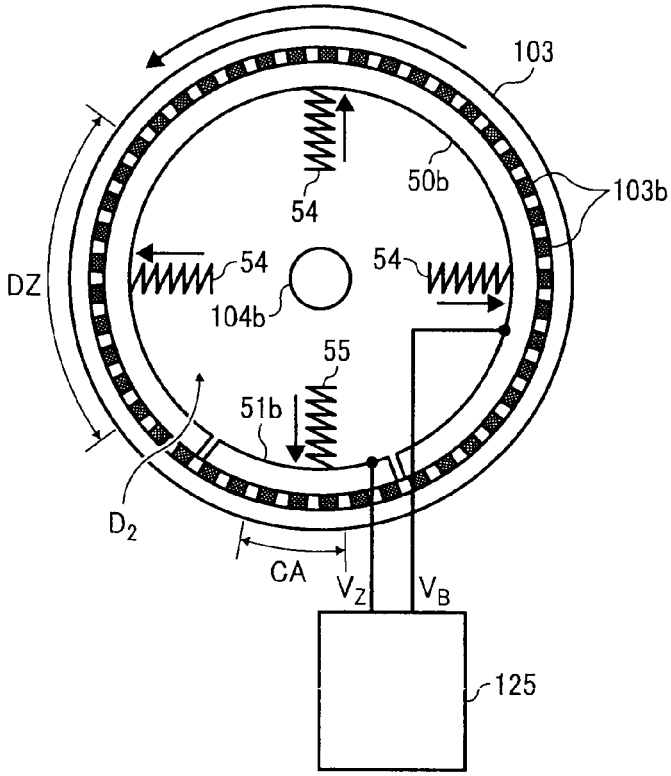
FIG. 16 is a side view schematically illustrating the developer roller of FIG. 11 from the second end.

FIG. 16 is a side view schematically illustrating the second end of the developer roller 103.

As shown in FIG. 16, the second set of electrodes 103*b* axially extend to the interior surface of the second recess D2 from the circumferential surface of the developer roller 103 defining the development zone DZ and the contact area CA mentioned above. Along the inner circumference of the recess D2, the major and minor stationary electrodes 50*b* and 51*b* are disposed stationary relative to the roller 103 rotating around the axle 104*b* counterclockwise in the drawing.

More specifically, the major electrode 50*b* is held in sliding contact with the ends of the electrodes 103*b* passing the development zone DZ, with the coil springs 54 urging the electrode 50*b* against the circumference of the recess D2. Similarly, the minor electrode 51*b* is held in sliding contact with the ends of the electrodes 103*b* passing the contact area CA with the coil spring 55 urging the electrode 51*b* against the circumference of the recess D2.

During operation, the voltage source 125 applies the periodic pulse voltage $V_B$ to the major stationary electrode 50*b*, and the DC voltage $V_Z$ to the minor stationary electrode 51*b*. As a result, the electrodes 103*b* are energized with the pulse voltage $V_B$ when passing through the development zone DZ, and with the DC voltage $V_Z$ when passing through the contact area CA.

Consequently, the voltage source 125 applies the antiphase pulse periodic $V_A$ and $V_B$ to the alternating electrodes 103*a* and 103*b* in the development zone DZ, and the DC voltage $V_Z$ to both electrodes 103*a* and 103*b* in the contact area CA closest to and/or in contact with the sealing blade 36. The periodic $V_A$ and $V_B$ establish an oscillating electric field to transfer toner toward the photoconductive surface as in the embodiments depicted hereinabove, while the DC voltage $V_Z$ establishes an electric field that directs charged toner particles toward the roller surface from the blade surface, and eventually allows them to pass through the contact area CA by following the moving surface of the roller 103. Thus, according to the embodiment described in FIGS. 11 through 16, the development device 1 enables toner to pass through the edge clearance of the opening in the developer housing without being prematurely removed by the sealing blade, in which the major stationary electrodes cause hopping motion of toner in the development zone and the minor stationary electrodes attract toner to the roller surface in the contact area. Numerous additional modifications and variations are possible in light of the above teachings. It is therefore to be understood that, within the scope of the appended claims, the disclosure of this patent specification may be practiced otherwise than as specifically described herein.

What is claimed is:

1. A development device that develops an electrostatic latent image recorded on a photoconductive surface, the development device comprising:

an open-ended housing to accommodate toner for application to the photoconductive surface through an end opening thereof;

a rotatable developer roller having an outer circumferential surface thereof partially accommodated within the housing and partially facing the photoconductive surface through the end opening to deliver the toner from within the housing to a development zone defined between the roller surface and the photoconductive surface;

an array of multiple primary electrodes aligned parallel with each other on and extending longitudinally along the roller surface;

a voltage source to apply a periodic pulse voltage to at least a subset of the primary electrodes to generate an oscillating primary electric field under which the toner moves back and forth between neighboring primary electrodes and consequently jumps across the development zone to adhere to the electrostatic latent image;

a sealing member to seal clearance between the roller surface and an edge of the end opening; and a secondary electrode facing at least a portion of the roller surface closest to the sealing member to generate, when energized, a secondary electric field to force the toner toward the roller surface to counteract an electrostatic force of the primary electric field repelling the toner from the roller surface.

2. The development device according to claim 1, wherein the sealing member is at least partially formed of a conductive material to serve as the secondary electrode.

3. A development device that develops an electrostatic latent image recorded on a photoconductive surface, the development device comprising:

an open-ended housing to accommodate toner for application to the photoconductive surface through an end opening thereof;

a rotatable developer roller having an outer circumferential surface thereof partially accommodated within the housing and partially facing the photoconductive surface through the end opening to deliver the toner from within the housing to a development zone defined between the roller surface and the photoconductive surface;

an array of multiple primary electrodes aligned parallel with each other on and extending longitudinally along the roller surface;

a voltage source to apply a periodic pulse voltage to at least a subset of the primary electrodes to generate an oscillating primary electric field under which the toner moves back and forth between neighboring primary electrodes and consequently jumps across the development zone to adhere to the electrostatic latent image;

a sealing member to seal clearance between the roller surface and an edge of the end opening downstream from the development zone; and a secondary electrode facing the roller surface upstream from a contact area between the sealing member and the roller surface to generate, when energized, a secondary electric field to force the toner from the sealing member toward the roller surface to counteract the sealing member interfering with the toner passing therethrough as well as an electrostatic force of the primary electric field repelling the toner from the roller surface.

4. The development device according to claim 3, wherein the secondary electrode comprises a conductive wire.

5. The development device according to claim 3, wherein the secondary electrode is affixed to the sealing member.

6. A development device that develops an electrostatic latent image recorded on a photoconductive surface, the development device comprising:

an open-ended housing to accommodate toner for application to the photoconductive surface through an end opening thereof;

a rotatable developer roller having an outer circumferential surface thereof partially accommodated within the housing and partially facing the photoconductive surface through the end opening to deliver the toner from within the housing to a development zone defined between the roller surface and the photoconductive surface;

an array of multiple electrodes aligned parallel with each other on and extending longitudinally along the roller surface;

a voltage source to apply a periodic pulse voltage to at least a subset of the electrodes to generate an oscillating electric field under which the toner moves back and forth between neighboring electrodes and consequently jumps across the development zone to adhere to the electrostatic latent image; and a sealing member to seal clearance between the roller surface and an edge of the end opening, the voltage source energizing at least one of the electrodes closest to the sealing member with a direct current voltage of a polarity opposite to that of the toner to counteract an electrostatic force of the electric field repelling the toner from the roller surface.

* * * * *